US005122288A

United States Patent [19]

Shiraishi et al.

[11] Patent Number: 5,122,288

[45] Date of Patent: Jun. 16, 1992

[54] COLD ROLLING OIL FOR STEEL SHEET

[75] Inventors: Kaoru Shiraishi; Takeru Sharyo, both of Fukuyama; Ryoichiro Takahashi, Yokohama; Masaaki Watanabe, Hiratsuka; Sakae Sonoda; Osamu Furuyama, both of Yokohama; Kouji Kaburagi, Yokohama, all of Japan

[73] Assignee: Nihon Parkerizing Co., Ltd., Japan

[21] Appl. No.: 671,192

[22] Filed: Mar. 18, 1991

Related U.S. Application Data

[63] Continuation-in-part of Ser. No. 525,446, May 18, 1990, abandoned.

[30] Foreign Application Priority Data

May 19, 1989 [JP] Japan ..... 1-126375

[51] Int. Cl.[5] ..... C10M 141/02

[52] U.S. Cl. ..... 252/52 A; 252/56 S; 252/56 R; 252/49.5; 72/42

[58] Field of Search ..... 252/52 A, 56 S, 56 R, 252/49.5; 72/42

[56] References Cited

U.S. PATENT DOCUMENTS

| | | | |
|---|---|---|---|
| 4,390,438 | 6/1983 | Kennedy et al. | 252/49.5 |
| 4,430,234 | 2/1984 | Hasegawa et al. | 252/49.5 |
| 4,518,512 | 5/1985 | Kanamori | 252/49.5 |
| 4,585,564 | 4/1986 | Tohmata et al. | 252/49.5 |
| 4,632,770 | 12/1986 | Slanker | 252/49.5 |
| 4,746,448 | 5/1988 | Kenmochi et al. | 252/56 S |
| 4,752,405 | 6/1988 | Kyle | 252/49.5 |
| 4,800,034 | 1/1989 | Akao et al. | 252/49.5 |
| 4,889,648 | 12/1989 | Higaki et al. | 252/49.5 |

*Primary Examiner*—Jacqueline Howard

*Attorney, Agent, or Firm*—Ostrolenk, Faber, Gerb & Soffen

[57] ABSTRACT

In the cold rolling oils for steel sheets of the present invention, when 0.2–5% by weight of a high molecular nonionic surfactant having a molecular weight of 2000–15000 and an HLB value of 5–9, as well as 0.2–5% by weight of another nonionic surfactant having 12–16 HLB value, are incorporated with a cold rolling oil as emulsifying and dispersing agents, anti-coalescence of oil particles emulsified and dispersed are remarkably improved, and they are less affected by inclusion of iron powder so that excellent stability with time in an emulsified and dispersed state is obtained, as well as that its plateout is significantly improved. Further, the concentration of the resulting cold rolling oils does not decrease, even in case of weak stirring force, so that stable performance with time are obtained.

In addition, when 0.1–10% by weight of an acetylene glycol nonionic surfactant is further incorporated with the above-described cold rolling oils for steel sheets of the invention, adverse effects due to inclusion of iron powder are safely avoided.

10 Claims, 1 Drawing Sheet

COLD ROLLING OIL FOR STEEL SHEET

BACKGROUND OF THE INVENTION

This is a continuation-in-part of application Ser. No. 525,446 filed May 18, 1990 and now abandoned.

The present invention relates to emulsion type cold rolling oils used in a process for cold rolling of steel sheets.

In cold rolling of steel sheets, a fluid dispersion (called a "coolant liquid") which is prepared by emulsifying and dispersing a cold rolling oil in hot water at a concentration of 1–10% is usually employed by circularly jetting the same for cooling the heat generated at the time of working the steel sheets and supplying lubricating oil to the rolling rolls and steel sheets.

The cold rolling oil is a composition obtained by incorporating an oiliness improver, an extreme-pressure additive and an emulsifying agent for emulsifying and dispersing a basic oil such as animal, vegetable and mineral oils, or various synthetic esters and the mixtures thereof obtained from two or more of these basic oil components.

The adhesion (plate-out) of a lubricating oil to steel sheets or rolling oils is significantly affected by the emulsified and dispersed state of the cold rolling oil. In general, a larger diameter of the emulsified and dispersed particles brings about the better plate-out so that lubricity is elevated. Furthermore, in rolling, stability in lubrication is important because variation in lubricity interferes with the rolling operation. However, there is a tendency that the emulsified and dispersed state of the cold rolling oil varies during storage of the coolant liquid in a coolant tank and circular use thereof, so that it is difficult to maintain a constant emulsified and dispersed state. For this reason, the lubricity varies and it will seriously interfere with working stability.

One of the reasons for variation with time in emulsification and dispersion is due to particle size growth as a result of coalescence of dispersed particles of lubricating oil, and another is that emulsification and dispersibility are affected adversely by inclusion of the iron powder produced at the time of rolling and working the iron sheets. While a cold rolling oil which has been emulsified and dispersed maintains particles having a comparatively uniform particle diameter which is well-balanced by its stirring condition in the early stage of the dispersion, the particle diameter distribution gradually covers over a wide range from small to large particles as a result of coalescence and destruction of the particles. Furthermore, as a consequence of inclusion of iron powder, coalescence of dispersed particles occurs, whereby particles having larger particle diameters are produced. Such large particle diameter lubricating oil particles float easily in the coolant liquid tank, so that they float or are caught by the coolant liquid dependent upon changes in the stirring conditions. Thus, the distribution of dispersed particle diameters of the lubricating oil in the coolant liquid to be supplied to rolls or rolling steel sheets fluctuates. As a result, its plate-out changes thereby to bring about variation in lubrication.

In order to avoid the phenomenon described above, the type, addition amount and the like of emulsifying and dispersing agents to be incorporated with a cold rolling oil has been studied. Heretofore, a nonionic emulsifier having a molecular weight of 1000 or less has been used as an emulsifying and dispersing agent to be incorporated with a cold rolling oil for steel sheets.

Recently, the use of water-soluble cationic high molecular compounds has also been studied and a part of which has been put to practical use for the sake of improving stability with time in respect of an emulsified and dispersed state. However, it is difficult to solve the problems as described above by the use of the nonionic emulsifier as previously mentioned herein. On one hand, while the stability with time is remarkably improved in respect of the emulsified and dispersed state in cases where a water-soluble cationic high molecular compound is used, such stability with time is easily influenced by water quality such as pH, hardness, components and the like of the water used because the emulsifier is cationic, on the other hand. Accordingly, water quality control is required and in addition, there arises another problem that since a water-soluble cationic high polymer exhibits no oil solubility, the cold rolling oil becomes a two-part liquid system so that its emulsifying and dispersing operability is poor.

In recent years, improvements in operating efficiency have been promoted by increase of rolling speed and draft, so that increasingly better lubricity and its stability with time are required for a cold rolling oil. In order to comply with such requirements, elevations in plate-out of a coolant liquid and stability of an emulsified and dispersed state are necessary.

OBJECT OF THE INVENTION

It is an object of the present invention to solve the various problems involved in conventional cold rolling oils mentioned above and to provide cold rolling oils which are excellent in lubricity and have good stability with time. Then, efficiency in cold rolling working may be elevated by the use of the cold rolling oils of this invention, whereby it is contemplated to contribute to the manufacture of cold-rolled steel sheets.

DESCRIPTION OF THE PREFERRED EMBODIMENTS

Figure 1:
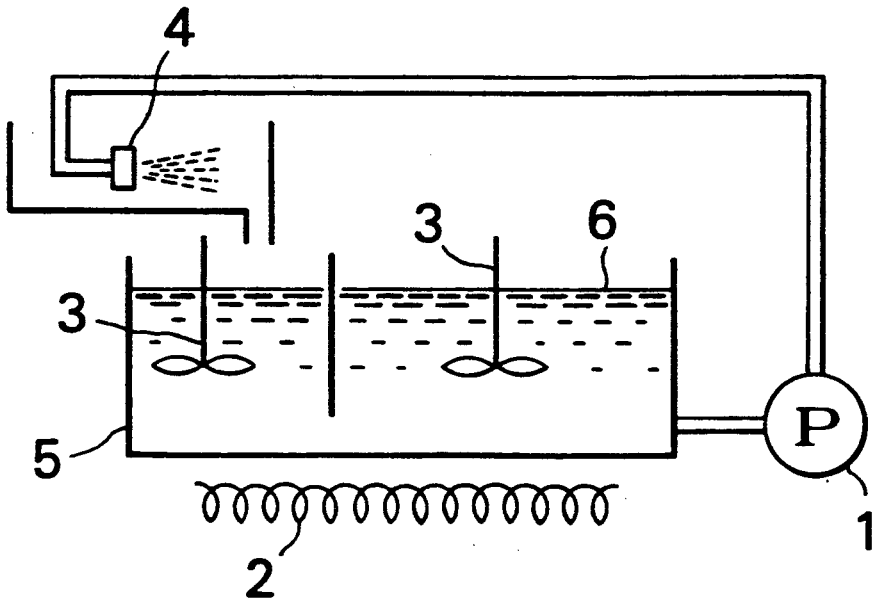
FIG. 1 is a schematic diagram showing a pump circulation tester for evaluating emulsifying and dispersing properties of a cold rolling oil.

The cold rolling oils for steel sheets according to the present invention have been completed on the basis of the discovery that when a specified nonionic surfactant is incorporated with a cold rolling oil, excellent emulsifying and dispersing properties which have never been realized heretofore can be afforded to the cold rolling oil. More specifically, the present inventors have discovered that when 0.2–5% by weight of a high molecular nonionic surfactant having a molecular weight of 2000–15000 and an HLB value of 5–9 is incorporated with a cold rolling oil as an emulsifying and dispersing agent, the anti-coalescence of oil particles emulsified and dispersed are remarkably improved, and it is less affected by inclusion of iron powder so that stability with time in an emulsified and dispersed state is obtained, as well as that its plate-out is significantly improved. However, even if only the above-described high molecular nonionic surfactant is incorporated with a cold rolling oil, a stable floating oil is produced with time so that it decreases the concentration of a cold rolling oil in the case where the stirring force is extremely weak. In this respect, it has been found that when 0.2–5% by weight of a nonionic surfactant having 12-16 HLB value is incorporated with a cold rolling oil, the concentration of the cold rolling oil does not decrease even in case of weak stirring force so that stable performance with time can be obtained.

Because of this finding, excellent cold rolling oils for steel sheets which have never been obtained may be prepared. In addition, as a result of the present inventors' further study, it has been discovered that when 0.1-10% by weight of acetylene glycol nonionic surfactant is further incorporated with the above-described cold rolling oils for steel sheets according to the present invention, adverse effects due to inclusion of iron powder can safely be avoided. Hence, separate novel cold rolling oils for steel sheets have also been invented herein.

More specifically, the present first invention relates to a cold rolling oil composition for steel sheets characterized by incorporating 0.2-5% by weight of a nonionic surfactant having a molecular 10 weight of 2000-15000 and an HLB value of 5-9 and 0.2-5% by weight of a nonionic surfactant having an HLB value of 12-16 with a cold rolling oil containing a basic oil selected from the group consisting of animal oils, vegetable oils, mineral oils, synthetic esters and the mixtures of two or more of them. The present second invention relates to a cold rolling oil composition for steel sheets characterized by further incorporating 0.1-10% by weight of an acetylene glycol nonionic surfactant with the cold rolling oil composition for steel sheets according to the first invention.

An example of the nonionic surfactants having a molecular weight of 2000-15000 and an HLB value of 5-9 includes copolymers of propylene glycol and ethylene glycol, as well as esters or polyesters prepared from fatty acids, polyfatty acids or polycondensed fatty acids and alcohols such as ethylene glycol, glycerin, sorbitol, sorbitan and the like or polyalcohols. When these surfactants have a molecular weight of less than 2000, the effects of anti-coalescence with respect to oil particles are inferior, while when the molecular weight exceeds 15000 so far as the surfactants which are obtained by the present inventors are concerned, oil solubility becomes poor. In case of an HLB value of less than 4 or more than 9, anti-coalescence is poor in either case; besides plate-out is not improved. Further, in the case where an amount of these surfactants to be added is less that 0.2% by weight, anti-coalescence effects with respect to oil particles are poor, while even if it exceeds 5% by weight, the oil is in a saturated condition so that the higher amount of addition is useless.

Examples of nonionic surfactants having an HLB value of 12-16 include polyoxyethylene alcohol ether, polyoxyethylene nonylphenyl ether, polyoxyethylene fatter ester, polyoxyethylene sorbitan ester, polyoxyethylene sorbitol ester and the like.

If the HLB value is less than 12, stability in an emulsified and dispersed state in case of weak agitation cannot be attained, while when the HLB value exceeds 16, oil solubility becomes inferior. An addition amount of the nonionic surfactants of the above-described type is sufficient for 0.2% by weight, and even if it exceeds 5% by weight, the effects in addition of the nonionic surfactants reach saturation. Accordingly, there is no need of the higher amount of addition.

The acetylene glycol nonionic surfactants have the following general formula:

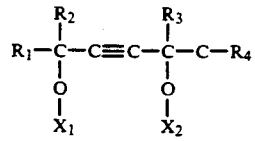

wherein $R_1$ and $R_4$ are H or $C_nH_{2n+1}$, $R_2$ and $R_3$ are H or $CH_3$, $X_1$ and $X_2$ are $(C_2H_4O)_nH$ or and n is an integer 1 or more.

In case where an addition amount of this type of the nonionic surfactants is less than 0.1% by weight, the adverse effects of inclusion of iron powder cannot be suppressed perfectly, while if it exceeds 10% by weight, the effects of addition of the surfactants are saturated, so that no more addition is needed.

The essential requisite for the cold rolling oils or steel sheets according to the present invention is to contain the above-specified nonionic surfactants in the basic oil, but it is to be noted that the cold rolling oils of this invention do not exclude incorporation of additives such as various oiliness improvers, extreme-pressure additives and the like which are generally employed in the art, and further they do not exclude such addition of the other surfactants if required.

As mentioned above, stability with time in emulsified and dispersed state of a cold rolling oil is affected by two major causes, i.e. coalescence of dispersed lubricating oil particles and inclusion of iron powder.

It is known in general that when the protecting action with respect to surfaces of dispersed articles is potent, excellent anti-coalescence is attained. Furthermore, the particle surfaces of such iron powder produced at the time of rolling steel sheets are lipophilic so that they are easily compatible with lubricating oil particles. As a result, the protecting action with respect to the surfaces of the lubricating oil particles is damaged by such compatible iron powder so that it brings about coalescence of lubricating oil particles to produce larger particles containing iron powder. Accordingly, in order to elevate stability with time in the emulsified and dispersed state of a cold rolling oil, it is required to make the protecting action with respect to surfaces of oil particles more potent to improve the anti-coalescent property and to make the lubricating oil so as not to be easily affected by produced iron powder.

For the sake of elevating anti-coalescent property, it is effective to thicken the protective films on the surfaces of oil particles, and at the same time in order to make the effects attained still stable with time, it is necessary that the protective films for oil particles exist stably on the interfaces thereof. Since the nonionic surfactants having a molecular weight of 2000-15000 and an HLB value of 5-9 used in the present invention are ones having a higher molecular weight than that of nonionic surfactants which have been heretofore employed, the former surfactants can thicken the protective films on the surfaces of oil particles. For this reason, coalescence of oil particles and adsorption of iron powder to the oil particles can be prevented. With respect to HLB value of a nonionic surfactant of the type described above, the reason why a value 5-9 is efficient is that oil solubility is too strong in cases where the HLB value is less than 5, while when it exceeds a value 9, water solubility becomes potential. As a result, the surfactant does not stably exist on the interfaces so that stable protective films cannot be obtained on the surfaces of oil particles. Moreover, as to action for improving plate-out, it is considered that such a high molecular weight nonionic surfactant having an HLB value of 5–9 easily produces a W/O emulsion, and in case of dispersion in hot water, W/O/W emulsion is produced so that plate-out is elevated. Thus, when a nonionic surfactant having a molecular weight of 2000–15000 and an HLB value of 5–9 is incorporated with a cold rolling oil, a coolant liquid having excellent anticoalescent property and plate-out can be obtained. However, when only this type of high molecular nonionic surfactant is incorporated, there is a tendency that the form of cold rolling oil emulsion shifts from W/O/W emulsion to W/O emulsion when the coolant liquid is weakly agitated. As a result, the stabilized W/O emulsion comes to float on the coolant liquid, and this is not desirable.

Since the W/O emulsion thus produced is hardly dispersed into the coolant liquid, although distribution of oil particle diameters in the coolant liquid does not change, it results in decrease in the concentration of the cold rolling oil. As a countermeasure, a nonionic surfactant having an HLB value of 12–16 is further incorporated with the above cold rolling oil, so that production of W/O emulsion is prevented, and a stabilized emulsion form can be obtained.

Next, explanation will be made on acetylene glycol nonionic surfactants. This type of surfactant has a triple bond at the central position of its molecule and OH groups at the positions adjacent thereto, so that the triple bond portion exhibits a strong polarity. Because of this polarity, the surfactant is adsorbed on the surfaces of produced iron powder, whereby the surfactant makes the iron powder surfaces hydrophilic. Accordingly, the adverse effects of inclusion of iron powder can perfectly be suppressed by the advantage of addition of the latter nonionic surfactant to the cold rolling oils of the first invention.

The advantages of the present invention will be made clearer hereinbelow by illustrating examples together with comparative examples.

<Surfactants under Test>

Group A . . . nonionic surfactants, molecular weight 2000–15000, HLB value 5–9 (including those being out of the range specified)

Group B . . . nonionic surfactants, HLB value 12–16 (including those having a value less than 12)

Group C . . . Acetylene glycol surfactants

Group D . . . Low-molecular weight (less than 2000) nonionic surfactants, HLB 5–9

Group E . . . Water-soluble high molecular cationic surfactants

| | | | |
|---|---|---|---|
| A - 1 | Pluronic L61, | HLB value 5.6, | MW 2000 |
| A - 2 | Pluronic L121, | HLB value 5.0, | MW 4500 |
| A - 3 | Hypermer A60, | HLB value 6.0, | MW 15000 |
| A - 4 | Hypermer B261, | HLB value 8.0, | MW 5000 |
| A - 5 | Hypermer B246, | HLB value 5.5, | MW 5000 |
| A - 6 | Pluronic L31, | HLB value 7.1, | MW 1100 |
| A - 7 | Pluronic L101, | HLB value 4.5, | MW 3800 |
| A - 8 | Hypermer A409, | HLB value 10.0, | MW 9000 |

("Pluronic" means polyalcohol type surfactants manufactured by Asahi Electrochemical Industries Co., Ltd. and "Hypermer" means ester type surfactants manufactured by ICI Company.)

| | |
|---|---|
| B - 1 | Polyoxyethylene (20 mol) sorbitan monooleate, HLB value 15.0 |
| B - 2 | Polyoxyethylene (9 mol) nonylphenyl ether, HLB value 13.0 |
| B - 3 | Polyoxyethylene (30 mol) stearate, HLB value 16.0 |
| B - 4 | Polyoxyethylene (40 mol) sorbitol tetraester, HLB value 12.5 |
| B - 5 | Polyoxyethylene (20 mol) sorbitan trioleate, HLB value 11.0 |
| B - 6 | Polyoxyethylene (6 mol) nonylphenyl ether, HLB value 10.8 |
| C - 1 | 2,4,7,9-tetramethyl-decyen-4,7-diol |
| C - 2 | Surfactant obtained by adding 4 mol of ethylene oxide to C - 1 |
| C - 3 | 3,6-dimethyl-4-octyn-3,6-diol |
| C - 4 | Surfactant obtained by adding 7 mol of ethylene oxide to C - 3 |
| D | Polyoxyethylene (3.5 mol) nonyphenyl ether, HLB value 8.2, MW 374 |
| E | Acetic acid salt of N,N-dimethylamino polymethacrylate (MW 100,000) |

<Cold Rolling Oil under Test>

In order to make a comparison in various performance assays, materials are prepared by adding a variety of surfactants to a mixture obtained by adding 3% of steric acid to tallow, and the materials thus prepared are used for the test.

Examples of the first invention

| | | |
|---|---|---|
| Example 1 | A - 1 (1%), | B - 1 (1%) |
| Example 2 | A - 2 (2%), | B - 2 (3%) |
| Example 3 | A - 3 (0.3%), | B - 3 (2%) |
| Example 4 | A - 4 (5%), | B - 4 (0.2%) |

Examples of the second invention

| | | | |
|---|---|---|---|
| Example 5 | A - 5 (1%), | B - 1 (4%), | C - 3 (1%) |
| Example 6 | A - 3 (1%), | B - 2 (1%), | C - 1 (5%) |
| Example 7 | A - 4 (3%), | B - 4 (1%), | C - 4 (0.1%) |
| Example 8 | A - 2 (2%), | B - 2 (3%), | C - 2 (9%) |

Comparative Examples

| | | |
|---|---|---|
| Comparative Example 1 | A - 3 (0.1%), | B - 3 (2%) |
| Comparative Example 2 | A - 6 (2%), | B - 4 (3%) |
| Comparative Example 3 | A - 7 (2%), | B - 4 (3%) |
| Comparative Example 4 | A - 8 (3%), | B - 2 (2%) |
| Comparative Example 5 | A - 7 (3%), C - 2 (0.05%) | B - 3 (4%) |
| Comparative Example 6 | A - 4 (3%), C - 4 (1%) | B - 1 (0.1%) |
| Comparative Example 7 | A - 4 (3%), C - 3 (2%) | B - 5 (1%) |
| Comparative Example 8 | B - 6 (3%) | |
| Comparative Example 9 | E (2%) | |
| Comparative Example 10 | Commercially available tallow cold rolling oil (acid value 5.8, saponification value 196) | |
| Comparative Example 11 | D (1%), | B - 1 (2%) |
| Comparative Example 12 | E (2%), | B - 1 (1%) |

<Performance Test>

1. Emulsion and Dispersion Stability (1) Stability with Time

An emulsifying and dispersing property test was carried out by the use of a pump circulation tester as shown in FIG. 1. In this equipment, the coolant liquid 6 is maintained in a tank 5 which is equipped with stirrers 3 and heating means 2. Pump 1 causes liquid 6 to circulate from the tank 5 through a sprayer. Thereafter, liquid 6 returns to tank 5 under the force of gravity. In the testing method, the ratio of the tank capacity for coolant liquid to the circulating amount as well as the stirring method simulated an actual apparatus.

Conditions: Coolant liquid, Concentration 3%, Temperature 60° C., Capacity 30 l, Using ion exchanged water, Circulating amount 4 l/min.

Testing Method: After stirring fresh oil for 3 hours and adding 1000 ppm of a produced iron powder gathered from a working site, agitation was further continued for 3 hours, and the average particle diameter of dispersed oil particles in a spray liquid was investigated as to its variation with time by the use of a coal-tar counter (TA-II type). Furthermore, only the stirrer (at 3 of FIG. 1) was stopped after completing the above-described test; the circulation was continued for 3 hours to produce a floating oil, and thereafter the stirrer was again operated, and the concentration of a spray liquid after circulating 1 hour was measured.

| | | Example (Average Particle Diameter μm) | | | | | | | |
|---|---|---|---|---|---|---|---|---|---|
| | | 1 | 2 | 3 | 4 | 5 | 6 | 7 | 8 |
| Fresh Oil | 1 hour | 10.2 | 9.8 | 10.6 | 10.5 | 9.6 | 10.6 | 9.5 | 9.8 |
| | 2 hours | 10.0 | 9.6 | 10.6 | 10.3 | 9.5 | 10.4 | 9.3 | 9.6 |
| | 3 hours | 10.0 | 9.5 | 10.4 | 10.4 | 9.5 | 10.4 | 9.2 | 9.6 |
| Adding Iron Powder After | 1 hour | 10.5 | 9.9 | 10.8 | 10.9 | 9.5 | 10.4 | 9.2 | 9.6 |
| | 2 hours | 11.0 | 10.3 | 11.2 | 10.9 | 9.6 | 10.4 | 9.4 | 9.6 |
| | 3 hours | 11.0 | 10.5 | 11.5 | 11.3 | 9.7 | 10.5 | 9.5 | 9.6 |
| Conc. After Test % | | 2.7 | 2.9 | 2.8 | 2.7 | 2.9 | 2.8 | 3.0 | 3.0 |
| Overall Evaluation* | | ○ | ○ | ○ | ○ | ◎ | ◎ | ◎ | ◎ |

*Evaluation Excellent ◎ ○ Δ X Inferior

| | | Comparative Example (Average Particle Diameter μm) | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Fresh Oil | 1 hour | 10.7 | 9.5 | 11.2 | 7.5 | 11.3 | 9.6 | 9.5 | 8.5 | 9.8 | 7.5 | 7.5 | 8.7 |
| | 2 hours | 10.8 | 10.6 | 12.5 | 8.0 | 12.2 | 9.7 | 9.8 | 9.0 | 10.0 | 7.0 | 8.0 | 8.6 |
| | 3 hours | 11.5 | 11.3 | 13.0 | 8.0 | 12.8 | 10.1 | 10.2 | 9.5 | 10.0 | 6.5 | 8.4 | 8.6 |
| Adding Iron Powder After | 1 hour | 12.0 | 11.5 | 13.5 | 9.0 | 13.6 | 10.2 | 10.3 | 12.0 | 10.5 | 8.0 | 10.5 | 9.3 |
| | 2 hours | 13.0 | 12.5 | 16.5 | 9.5 | 15.5 | 10.2 | 10.3 | 12.5 | 10.7 | 10.0 | 11.3 | 9.4 |
| | 3 hours | 15.5 | 14.6 | 17.7 | 10.0 | 16.0 | 10.5 | 10.3 | 13.6 | 10.8 | 14.5 | 12.6 | 9.4 |
| Conc. After Test % | | 2.0 | 2.2 | 2.4 | 2.8 | 2.6 | 1.3 | 1.5 | 2.2 | 2.9 | 2.1 | 12.4 | 3.0 |
| Overall Evaluation* | | X | X | X | Δ | X | X | X | X | ○ | X | X | ○ |

*Evaluation: Excellent ◎ ○ Δ X Inferior (2) Influence by Quality of Water Used

A: Ion exchanged water

B: Water obtained by adjusting pH of ion exchanged water to a value 8 by using NaOH C: Hard water (total hardness 150 ppm)

The above enumerated water was used as water for dispersion, and a pump circulating test was effected by employing a fresh oil under the same conditions as that of the above-mentioned test for 1 hour, and average particle diameter was confirmed.

| | | Example (Average Particle Diameter μm) | | | | | | | |
|---|---|---|---|---|---|---|---|---|---|
| | | 1 | 2 | 3 | 4 | 5 | 6 | 7 | 8 |
| Water Used | A | 10.2 | 9.8 | 10.6 | 10.5 | 9.6 | 10.6 | 9.5 | 9.8 |
| | B | 10.3 | 9.6 | 10.5 | 10.6 | 9.4 | 10.6 | 9.4 | 9.9 |
| | C | 10.4 | 9.6 | 10.5 | 10.4 | 9.5 | 10.6 | 9.2 | 9.8 |
| Evaluation* | | ◎ | ◎ | ◎ | ◎ | ◎ | ◎ | ◎ | ◎ |

*(Evaluation is the same as that defined in the previous test.)

| | | Comparative Example (Average Particle Diameter μm) | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Water Used | A | 10.7 | 9.5 | 11.2 | 7.5 | 11.3 | 9.6 | 9.5 | 8.5 | 9.8 | 7.5 | 7.5 | 8.7 |
| | B | 10.6 | 9.4 | 11.2 | 7.4 | 11.5 | 9.4 | 10.1 | 8.2 | 15.5 | 7.2 | 7.2 | 12.6 |
| | C | 11.5 | 9.7 | 11.0 | 8.5 | 11.5 | 9.8 | 9.9 | 9.6 | 16.7 | 8.3 | 8.5 | 13.4 |
| Evaluation* | | ○ | ◎ | ◎ | ○ | ◎ | ◎ | ○ | ○ | X | ○ | ○ | X |

*(Evaluation is the same as that defined in the previous test.)

2. Plate-out

A steel sheet was sprayed with each testing cold rolling oil emulsion, and plate-out thereof was evaluated.

Conditions: Concentration 3%, Temp. 60° C. Spray flow rate 600 cc/min. Spray time 0.5 sec. Temp. of steel sheet 100° C.

Evaluation

A pickup of lubricating oil was measured in accordance with gravimetric method.

| | Example | | | | | | | |
|---|---|---|---|---|---|---|---|---|
| | 1 | 2 | 3 | 4 | 5 | 6 | 7 | 8 |
| Pickup $mg/m^2$ | 520 | 480 | 500 | 560 | 490 | 550 | 450 | 470 |

| | Comparative Example | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Pickup mg/m$^2$ | 310 | 320 | 340 | 280 | 350 | 370 | 320 | 350 | 300 | 320 | 280 | 290 |

3. Rolling Test

A rolling test was effected by the use of each testing cold rolling oil emulsion to investigate lubricity.

Conditions

| | |
|---|---|
| Emulsion | Concentration 3%, Temperature 60° C. |
| Rolling rolls: | 530 mm $\phi$ |
| Rolling speed: | 1800 mpm |
| Rolling sheet: | SPCCB material 2 × 20 × 850 mm |
| Draft | 25% |

Evaluation

The evaluation was effected in a rolling load per unit width.

| | Example | | | | | | | |
|---|---|---|---|---|---|---|---|---|
| | 1 | 2 | 3 | 4 | 5 | 6 | 7 | 8 |
| Rolling Load kg/mm$^2$ | 846 | 848 | 845 | 840 | 847 | 836 | 852 | 846 |

| | Comparative Example | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Rolling Load kg/mm$^2$ | 876 | 874 | 872 | 886 | 880 | 875 | 876 | 874 | 884 | 876 | 887 | 883 |

As indicated in the above test results, the cold rolling oils for steel sheets according to the present invention have excellent emulsion and dispersion stability, as well as excellent plate-out, so that it may be said that the cold rolling oils of the present invention have also excellent lubricity.

As described above, the cold rolling oils for steel sheets according to the present invention exhibit excellent emulsion and dispersion stability, as well as excellent plate-out due to effects of the specified nonionic surfactants incorporated with the basic oils of the invention. Accordingly, the cold rolling oils for steel sheets according to the present invention have such excellent advantages that they can provide improvement in lubricity and stability of working in cold rolling operation, whereby its working efficiency can be elevated.

What is claimed is:

1. A cold rolling oil composition comprising a member selected from the group consisting of animal oils, vegetable oils, mineral oils, synthetic esters and the mixtures of two or more of them as a basic oil; 0.2–5% by weight of a nonionic surfactant having a molecular weight of 2000–15000 and an HLB value of 5–9; and 0.2–5% by weight of a nonionic surfactant having an HLB value of 12–16.

2. The cold rolling oil composition of claim 1 in which said nonionic surfactant having an HLB value of 5–9 is an ester or polyalcohol and the nonionic surfactant having an HLB value of 12–16 is an ethoxylated ester or ether.

3. The cold rolling oil composition of claim 2 in which said nonionic surfactant having an HLB value of 5–9 is present in an amount of 0.3–5% by weight and has an HLB value of 5–8 and in which said nonionic surfactant having an HLB value of 12–16 is present in an amount of 0.2–3% by weight and has an HLB value of 12.5–15.

4. A cold rolling oil composition comprising a member selected from the group consisting of animal oils, vegetable oils, mineral oils, synthetic esters and the mixtures of two or more of them as a basic oil; 0.2–5% by weight of a nonionic surfactant having a molecular weight of 2000–15000 and an HLB value of 5–9; 0.2–5% by weight of a nonionic surfactant having an HLB value of 12–16; and 0.1–10% by weight of an acetylene glycol nonionic surfactant.

5. The cold rolling oil composition of claim 4 in which said nonionic surfactant having an HLB value of 5–9 is an ester or polyalcohol and the nonionic surfactant having an HLB value of 12–16 is an ethoxylated ester or ether.

6. The cold rolling oil composition of claim 5 in which said nonionic surfactant having an HLB value of 5–9 is present in an amount of 1–3% by weight, has a molecular weight of 4500–15000 and an HLB value of 5–8, said nonionic surfactant having an HLB value of 12–16 is present in an amount of 1–4% and has an HLB value of 12.5–15, and in which said acetylene glycol nonionic surfactant is present in an amount of 0.1–9% by weight.

7. A cold rolling oil composition comprising a base oil selected from the group consisting of animal oils, vegetable oils, mineral oils, synthetic esters and mixtures thereof and a surfactant mixture consisting essentially of 0.2–5% by weight of the composition of a nonionic surfactant having a molecular weight of 2000–15000 and an HLB value of 5–9, 0.2–5% by weight of the composition of a nonionic surfactant having an HLB value of 12–16 and optionally 0.1–10% by weight of the composition of an acetylene glycol nonionic surfactant.

8. The cold rolling oil composition of claim 7 in which said nonionic surfactant having an HLB value of 5–9 is an ester or polyalcohol and the nonionic surfactant having an HLB value of 12–16 is an ethoxylated ester or ether.

9. The cold rolling oil composition of claim 8 in which said nonionic surfactant having an HLB value of 5–9 is an ester or polyalcohol and the nonionic surfactant having an HLB value of 12–16 is an ethoxylated ester or ether.

10. The cold rolling oil composition of claim 8 in which said nonionic surfactant having an HLB value of 5–9 is present in an amount of 1–3% by weight, has a molecular weight of 4500–15000 and an HLB value of 5–8, and said nonionic surfactant having an HLB value of 12–16 is present in an amount of 1–4% and has an HLB value of 12.5–5.15.

* * * * *